US005226550A

United States Patent [19]

Mikolaitis et al.

[11] Patent Number: 5,226,550

[45] Date of Patent: Jul. 13, 1993

[54] SYNTHETIC RESIN BOTTLE WITH HANDGRIPS

[75] Inventors: William B. Mikolaitis, Lilburn; Stephen W. Cornell, Roswell, both of Ga.

[73] Assignee: Silgan Plastics Corporation, Chesterfield, Mo.

[21] Appl. No.: 902,981

[22] Filed: Jun. 23, 1992

[51] Int. Cl.[5] ..... B65D 1/02; B65D 1/42; B65D 23/10

[52] U.S. Cl. ..... 215/1 C; 215/100 A; 220/771

[58] Field of Search ..... 215/1 C, 100 A; D9/540, D9/530; 220/771

[56] References Cited

U.S. PATENT DOCUMENTS

| | | | |
|---|---|---|---|
| D. 167,914 | 10/1952 | Taranton | D24/147 |
| D. 198,404 | 6/1964 | Busch . | |
| D. 214,550 | 7/1969 | Plummer | D9/540 |
| D. 218,018 | 7/1990 | Lattraye | D9/530 |
| D. 231,904 | 6/1974 | Boden | D9/540 |
| D. 258,346 | 2/1981 | Winchell et al. | D9/370 |
| D. 258,720 | 3/1981 | Evans et al. | D9/370 |
| D. 277,551 | 2/1985 | Kerr | D9/409 |
| D. 294,117 | 2/1988 | Rogler et al. | D9/411 |
| D. 294,120 | 2/1988 | Griesing et al. | D9/403 |
| D. 294,463 | 3/1988 | Lang | 215/1 C X |
| D. 295,612 | 5/1988 | Ota | D9/392 |
| D. 306,969 | 4/1990 | Alberghini et al. | D9/378 |
| D. 319,011 | 8/1991 | Biesecker | D9/540 |
| 3,225,950 | 12/1965 | Josephsen et al. | 215/1 C X |
| 3,536,223 | 10/1970 | Muhlhoff et al. | 215/1 C |
| 4,804,097 | 2/1989 | Alberghini et al. | 215/100 A |
| 4,805,788 | 2/1989 | Akiho | 215/1 C |
| 4,890,752 | 1/1990 | Ota et al. | 215/1 C |
| 4,993,565 | 2/1991 | Ota et al. | 215/1 C |

FOREIGN PATENT DOCUMENTS

| | | | |
|---|---|---|---|
| 1337902 | 8/1963 | France | 215/1 C |
| 9100829 | 1/1991 | PCT Int'l Appl. | 215/1 C |
| 9104912 | 4/1991 | PCT Int'l Appl. | 215/1 C |

*Primary Examiner*—Sue A. Weaver

[57] ABSTRACT

A blow molded synthetic resin container has a body portion with a bottom wall and a sidewall of generally circular cross section, and a closure portion. The sidewall has a pair of vertically elongated grip recesses defined by top and bottom walls and first and second walls extending therebetween and converging along an axial line at the maximum depth of the recess, with the inward angle of one hung steeper than the other. The grip recess has a convex bridge rib extending horizontally and rectilinearly between the first and second walls and terminating at points spaced inwardly of the periphery of the sidewall to space its rectilinear outer surface inwardly of the periphery. The first wall also has a plurality of ribs of smaller height and width than the bridge rib extending axially from both side surfaces of the bridge rib.

12 Claims, 7 Drawing Sheets

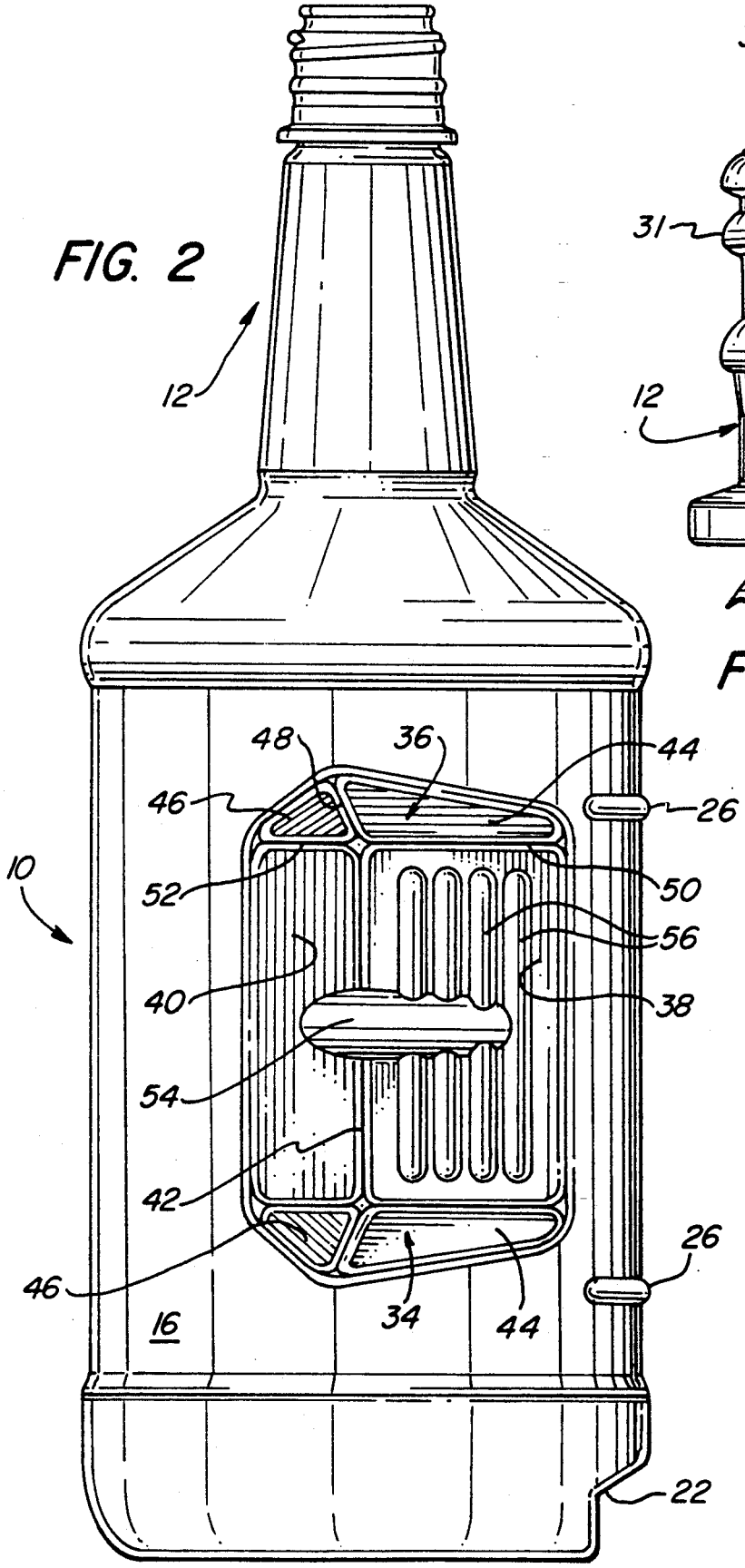
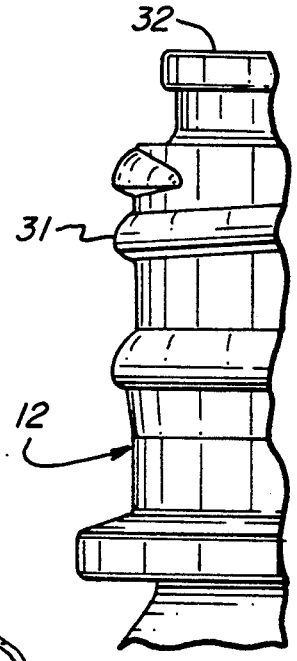
FIG. 3

FIG. 5
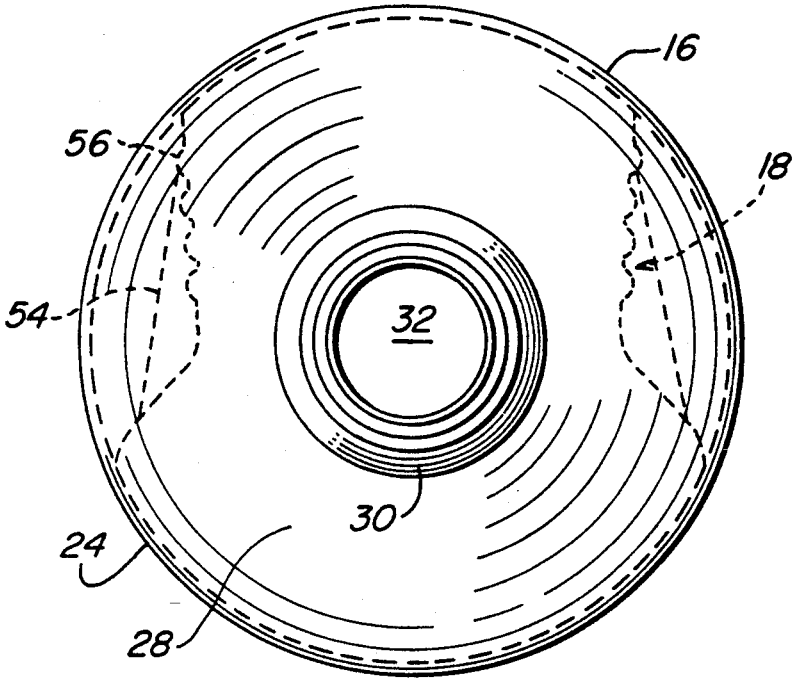
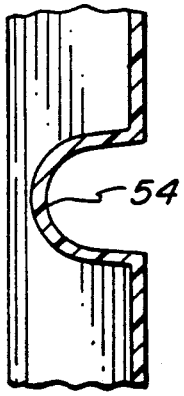
FIG. 7
FIG. 6
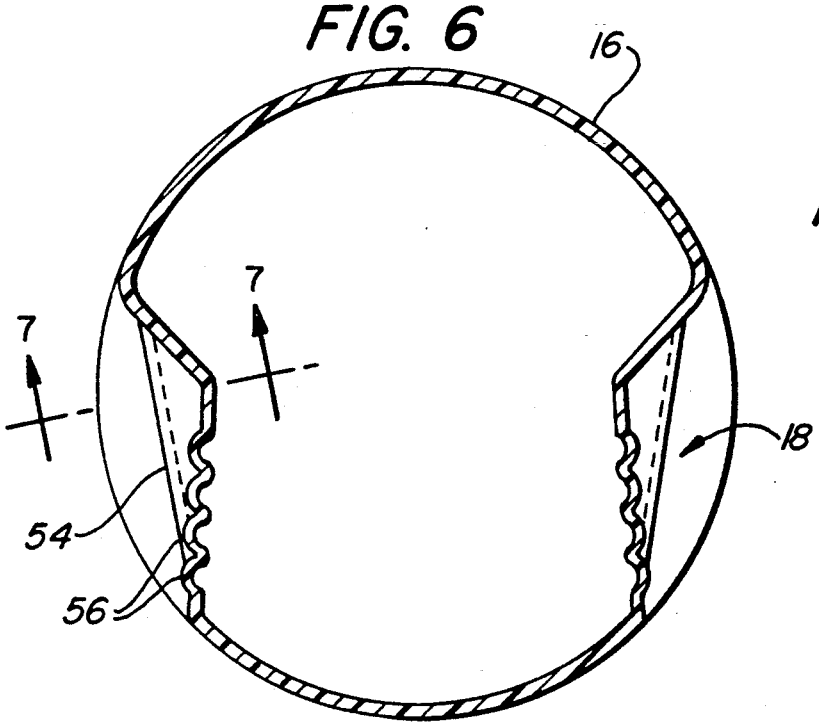

D
C
I
11
12
34
54
18
40
B
56
38
C
Y
Z 36
40
54
34
X
A
W

SYNTHETIC RESIN BOTTLE WITH HANDGRIPS

BACKGROUND OF THE INVENTION

The present invention relates to synthetic resin containers and, more particularly, to blow molded synthetic resin containers having grip recesses formed about the periphery thereof.

As is well known, blow molded synthetic resin containers are now widely employed for many applications and are produced in a variety of sizes and configurations. Such containers are intended to provide not only for protective storage of the product contained therein, but also for easy dispensing or pouring of the contents. As a result, various container configurations have been proposed to permit facile gripping of the container by the user, particularly when the surface of the container may be moist and provide an opportunity for slippage to occur in the user's hand. To achieve this result, ribs, roughening and various types of formations have been suggested and employed on the surface of the container.

In addition, there have been a number of efforts to provide grip recesses about the periphery of the container to receive the user's thumb and fingers so as to improve the gripping ability. Exemplary of such designs are Ota et al U.S. Pat. No. 4,890,752 and Alberghini et al U.S. Pat. No. 4,804,097. As is discussed in both of these patents, there is a tendency for such grip recesses to evert as a result of internal pressure from the contents alone or from the stresses which result from dropping the filled container even a small distance. As a result, both Ota et al and Alberghini et al propose to provide transverse ribs within the grip recesses to increase the resistance to eversion under shock loading.

In the Ota et al and Alberghini et al patents, a multiplicity of transversely extending ribs are shown in each rib. However, it has also been suggested to provide recesses with axially extending ribs such as seen in Kerr U. S. Design Pat. No. 277,551. In practice such prior ribbed constructions for the grip recess have not proven particularly effective in resisting the tendency for eversion in a drop test which is critical to the adoption of such container designs for widespread application.

Accordingly, it is an object of the present invention to produce a blow molded synthetic resin container having grip recesses formed about the periphery thereof which exhibit a high degree of resistance to eversion under shock loading and internal pressure.

It is also an object to provide such a container in which a single transverse rib in the grip recesses may provide such resistance to eversion even in grip recesses of substantial axial dimension, thus enabling the user to dispose a multiplicity of fingers within the grip recess.

Another object is to provide such a container which may be readily manufactured and which may be modified in grip recess configuration to permit grip recesses of even greater axial dimension.

SUMMARY OF THE INVENTION

It has now been found that the foregoing and related objects may be readily attained in a blow molded synthetic resin container having a body portion with a bottom wall and a sidewall of generally circular cross section, and a closure portion at the upper end of the sidewall and providing an opening to the container body portion and adapted to receive a closure. The sidewall of the body portion has a pair of vertically elongated grip recesses therein spaced about its periphery, and each of the grip recesses is defined by top and bottom walls and first and second walls extending therebetween and converging along an axial line at the maximum depth of the recess. The first wall extends inwardly of the periphery of the body portion at a relatively shallow angle to an imaginary chord drawn between the side edges of the recess, and the second wall extends inwardly at a steeper angle.

The grip recess has a convex bridge rib extending horizontally and rectilinearly between the first and second walls and terminating at points spaced inwardly of the periphery of the sidewall to space its rectilinear outer surface inwardly of the periphery a distance of about $\frac{1}{4}$–$\frac{3}{4}$ the maximum depth of the recess, and the bridge rib has a width of about $\frac{1}{4}$–$\frac{3}{4}$ inch. The first wall also has a plurality of axially extending ribs of smaller height and width extending axially from the upper and lower side surfaces of the bridge rib.

In the preferred embodiments, in the bridge rib is of generally inverted U-shaped cross section and substantially bisects the axial length of the grip recess.

Desirably, the top and bottom walls defining the recess are inclined inwardly to a smaller axial spacing therebetween at their inner ends along their lines of convergence with the first and second walls. Each of the top and bottom walls of the grip recess has first and second portions extending along the first and second walls respectively and converging along a line which is inclined relative to a plane extending transversely of the axis of the body portion, to a reduced axial distance between the inner ends of the lines, and the edges of the first and second portions spaced from the first and second walls define the upper and lower margins of the grip recess and extend along the periphery of the body portion and at an angle to the axis thereof to provide an increased axial distance between the top and bottom walls at the line of convergence of the first and second portions.

Generally, the grip recesses has an axial length of 2–5 inches. The lines of convergence of the first and second walls of the pair of grip recesses are substantially diametrically spaced about the periphery of the container.

Desirably, the first wall extends at relatively shallow angle of 10°–35° to the imaginary chord extending between the side edges of the recess, and the second wall extends a steeper angle of 25°–75° to the chord. The change in direction at the line of convergence between the walls defining the recess is relatively sharp, to provide a stiffening configuration. The extending ribs have a height of about 0.06–0.12 inch, and a width of about 0.08–0.25 inch.

BRIEF DESCRIPTION OF THE DRAWINGS

FIG. 2 is a side elevational view thereof;

FIG. 3 is a fragmentary elevational view through the thread portion of the container neck and drawn to an enlarged scale;

FIG. 5 is a top view thereof;

FIG. 6 is a sectional view along the line 6—6 of FIG. 4;

FIG. 7 is a fragmentary sectional view along the line 7—7 of FIG. 6;

DETAILED DESCRIPTION OF THE PREFERRED EMBODIMENTS

Figure 1:
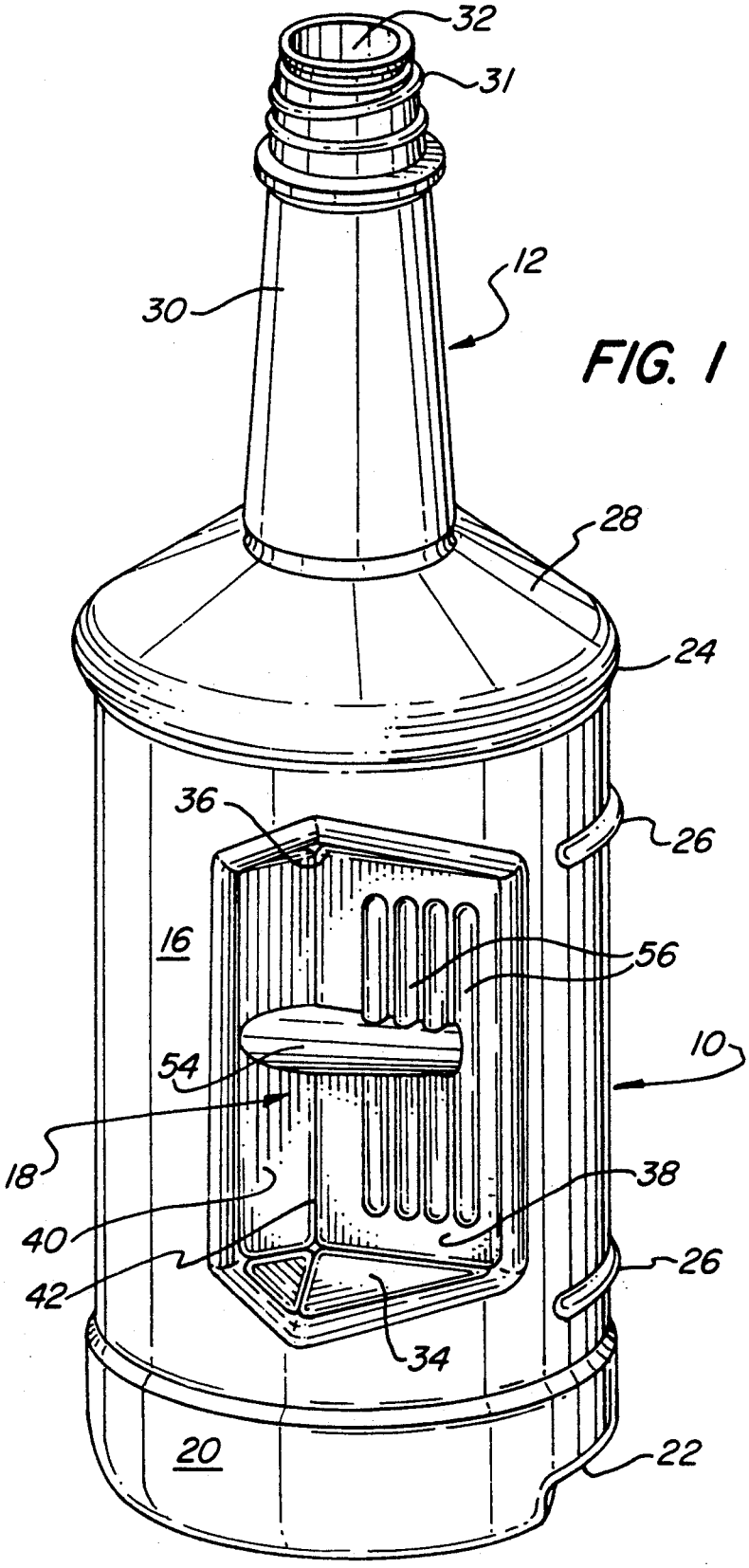
FIG. 1 is a perspective view of a blow molded synthetic resin bottle embodying the present invention.
Figure 4:
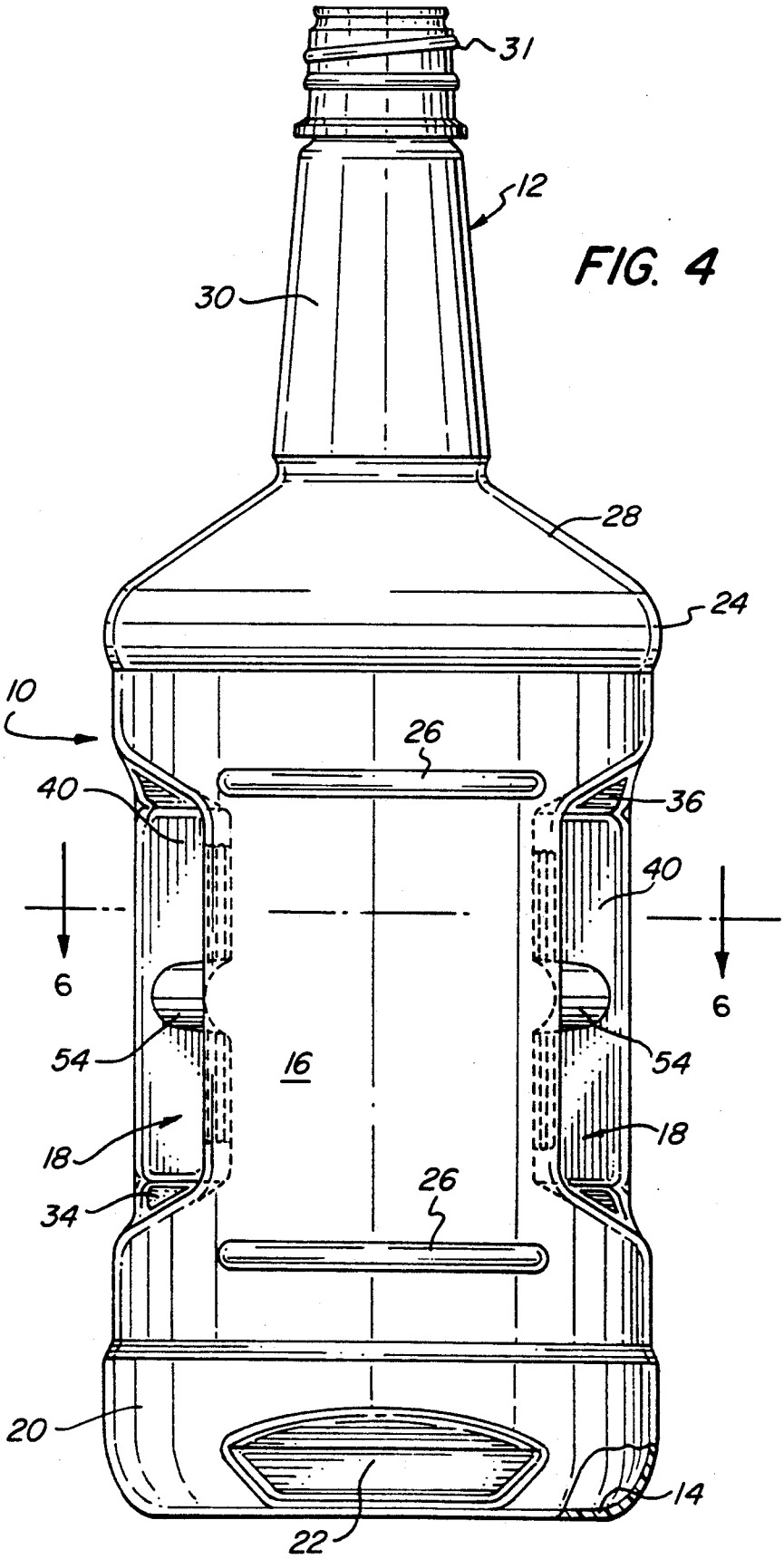
FIG. 4 is an elevational view of the container rotated 90° from the position seen in FIG. 2 and with a portion of the sidewall broken away.

Turning first to FIGS. 1-4 of the attached drawings, a container embodying the present invention has a body portion generally designated by the numeral 10, and an upper closure portion generally designated by the numeral 12. The body portion 10 has a bottom wall 14 (seen in FIG. 4) and a peripheral wall 16 with a generally circular cross section except at the pair of grip recesses which are generally designated by the numeral 18.

At its lower end, the peripheral wall 16 has an enlarged base portion 20 with an indexing step 22 at the point about its periphery to facilitate locating the label (not shown) during the automatic labelling operation. At its upper end the peripheral wall has an enlarged shoulder 24 and a pair of peripherally extending ribs 26 is disposed between the grip recesses 18 for location and protection of the label (not shown).

The closure portion 12 has a tapering collar section 28 and enlongated neck 30 of more steeply tapering configuration with a threaded portion 31 at the upper end thereof, and an opening 32 into the container is provided at the upper end of the neck 30.

Turning now to the grip recesses 18, each has a transversely extending bottom wall 34 and top wall 36 defining the upper and lower margins thereof, and the inner surface of the recess is defined by a first or major wall 38 which extends inwardly from the periphery at a relatively shallow angle to an imaginary chord drawn between the side edges of the recess 18, and a second or minor wall 40 which extends inwardly at a steeper angle. The walls 38 and 40 converge along an axially extending line of convergence 42 at a relatively sharp angle.

As seen in FIG. 2, the bottom and top walls 34, 36 are each comprised of a first portion 44 and second portion 46 generally coextensive with the first wall 38 and second wall 40, and these converge along an inclined line of convergence 48. They also converge with the first and second walls 38, 40 along lines of convergence 50, 52. As seen, the first and second portions 44, 46 of the bottom and top walls 34, 36 are oppositely angularly oriented at their outer ends so that the wall portions 44, 46 are angularly oriented relative to each other and are inclined inwardly to the walls 38, 40. As a result, they are spaced apart a greater distance at the outer end of their line of convergence 48.

Intermediate the axial length of the grip recesses 18 is a relatively large bridge rib 54 of generally inverted U-shaped configuration which extends horizontally and rectilinearly between the first and second walls 38, 40 defining the inner surface of the grip recess 18. The outer surface of the bridge rib 54 is spaced inwardly from the side edges of the first and second walls 38, 40 so that it extends chordally at a distance spaced inwardly from the periphery of the peripheral wall 16 over its entire length. The first wall 38 is also provided with a series of axially extending ribs 56 of substantially smaller dimension than the bridge rib 54 and which intersect with and extend from the upper and lower side surfaces of the bridge rib 54.

Figure 8:
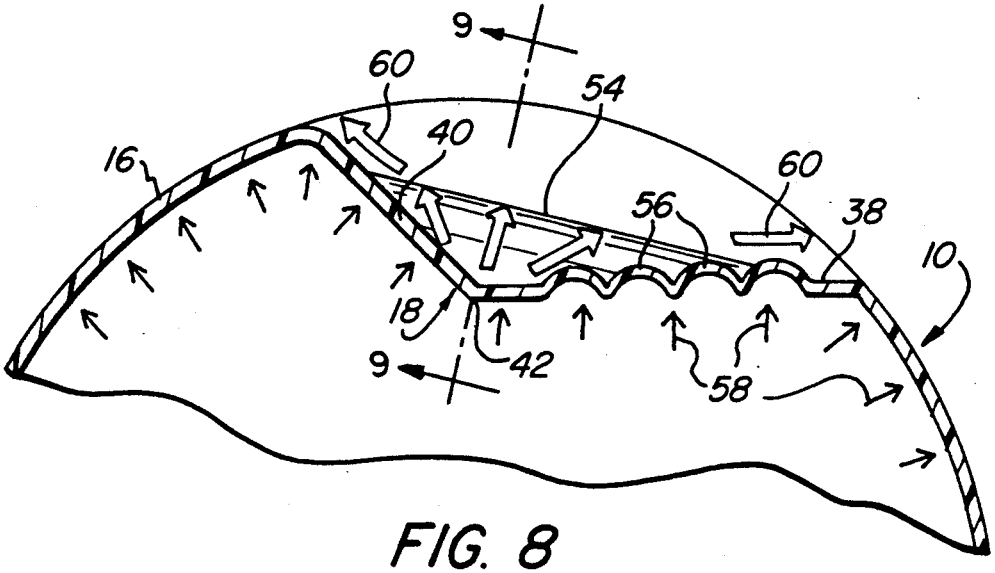
FIG. 8 is a diagrammatic view of the grip portion of the recess along the line of the bridge rib showing schematically the force loads from internal hydrostatic pressure and the manner of distribution of those force loads tangentially of the container.
Figure 9:
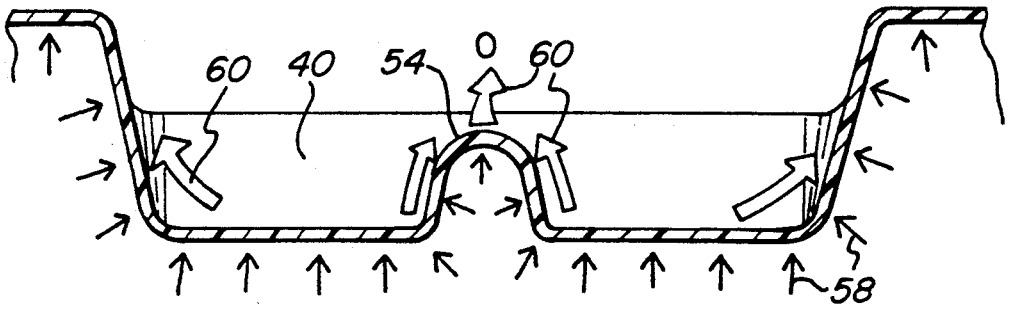
FIG. 9 is a similar schematic view transversely of the bridge rib; showing the force loads and the dissipation of these forces to the hoop direction of the container.
Figure 12:
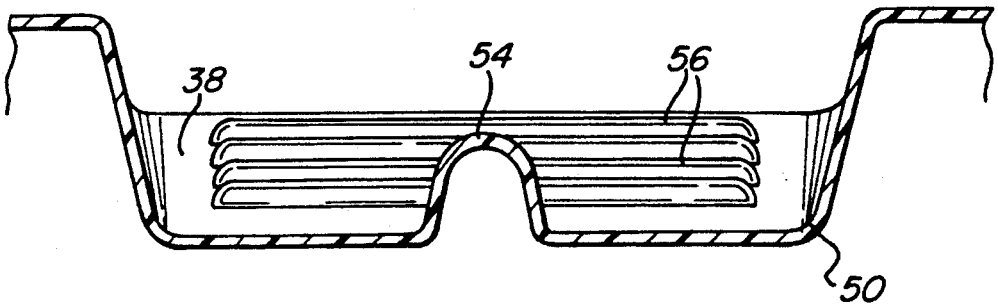
FIGS. 11 and 12 are sectional views along the line 11—11 and along the line 12—12 respectively of FIG. 10.

Turning now to FIGS. 8 and 9, the functioning of the horizontal bridge rib 54 to resist eversion of the grip recess 18 is schematically illustrated. The small arrows 58 indicate the hydrostatic pressures acting upon the surface of the container about the grip recess 18 and the larger arrows 60 indicate the manner in which the forces 58 are translated by the bridge rib 54 into tangential forces substantially oriented in the hoop direction of the peripheral wall 16. As a result, the substantial eversion forces acting in the area of the grip recess 18 are effectively translated into forces which can be resisted by the circular configuration of the body portion 10 over the major portion of its surface area.

The relatively shallow axial ribs 56 serve to translate the hydrostatic pressure acting upon the larger surface area of the first wall 38 into the bridge rib 54 which increases its effectiveness over a relatively large axial length of the grip recess 18. The lines of convergence 48, 50, and 52 further serve to stiffen the upper and lower margins of the grip recess 18 and cooperate with the bridge rib 54 and axial ribs 56 in resisting and distributing the hydrostatic pressure to the circular periphery of the body portion 10.

Figure 11:
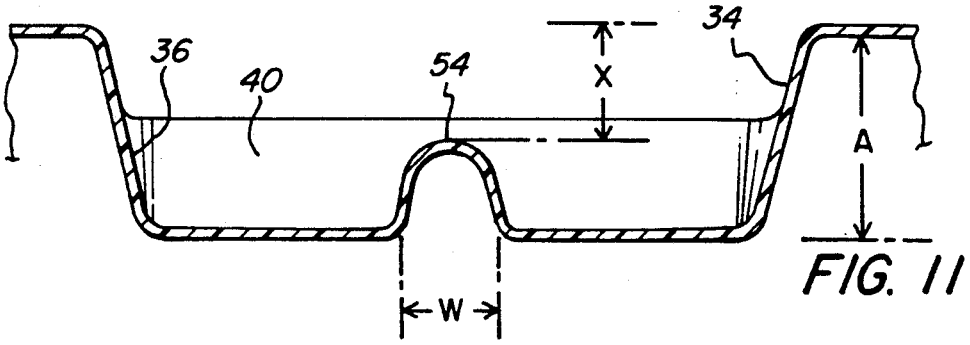

As seen in FIG. 11, the bridge rib 54 has its outer surface spaced inwardly of the periphery of the side wall a distance of X which will generally be approximately $\frac{1}{2}$ to $\frac{3}{4}$ the maximum depth of the recess indicated by the line A to provide the desired degree of stiffness in the rib and to effectively transfer the hydrostatic pressure forces acting upon the walls 38 and 40 of the recess into tangential forces distributed into the circular periphery of the body portion. Preferably, the rib 54 will be dimensioned so that its outer surface is spaced inwardly from the periphery a distance X of about $\frac{5}{8}$ of the total depth A of the recess.

With respect to the width of the rib 54, this is indicated in FIG. 11 by the letter W, and will normally be in the range of 0.25–0.75 inch as measured along the line of convergence 48 since its end portions taper due to the inclined surface of the wall portions 38, 40. The preferred width is about 0.4–0.6 inch.

Figure 10:
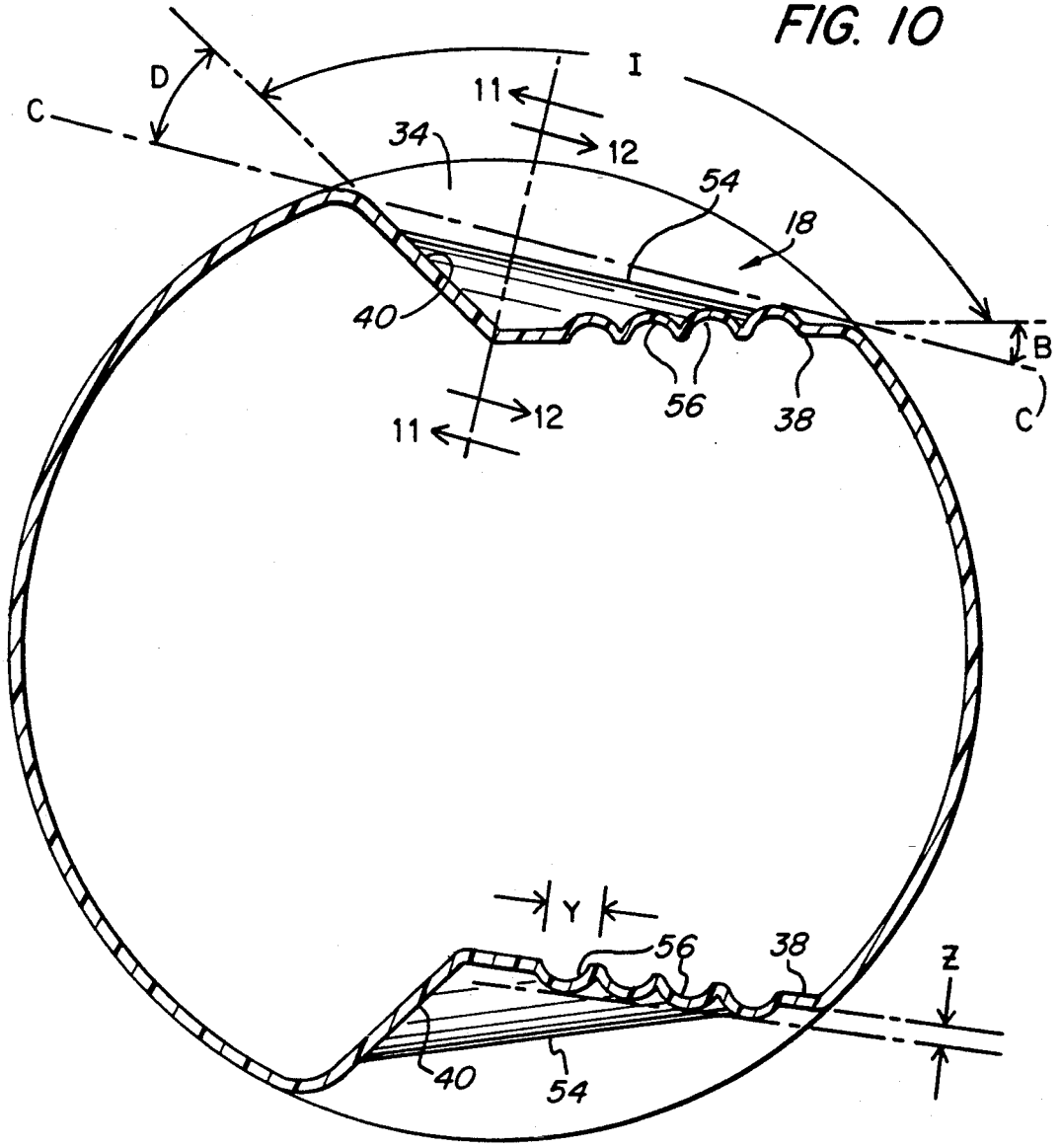
FIG. 10 is a sectional view in the grip area showing dimensional indicia.

As also seen in FIG. 10, the first or major wall 38 extends inwardly from the periphery of the container at a relatively shallow angle B about 10°–35° to the imaginary chord C drawn between the side edges of the grip recess 18 and the second wall 40 extends inwardly at a steeper angle D at about 25°–75° to the imaginary chord C. In practice, the preferred angular relationships for the B and D are 15°–20° and 30°–40°

The walls 38, 40 converge at a relatively sharp radius of about 0.1 inch and the included angle I between them is 80°–140° and preferably about 80°–100°.

As seen in FIG. 10, the shallow axial ribs 56 has a height Z desirably in the range of 0.05–0.12 inch in height and a width Y desirably in the range of about 0.08–0.250 inch. Preferably, these axially extending ribs are about 0.06–0.07 inch in height and 0.10–0.14 inch in width. Desirably, they extend from the bridge rib 54 over at least ½ the spacing between the bridge rib 54 and the adjacent bottom or top wall 34, 36.

Although the wall thickness of the grip recess will vary depending upon the draw ratio of the geometry, generally the wall thickness of the container should be in the range of 0.015–0.021 inch and preferably about 0.017–0.020 inch. The bridge rib should have a minimum wall thickness of about 0.008 inch and preferably about 0.010–0.015 inch.

Although a single bridge rib will be effective for most grip dimensions of up to about 5 inches, two or more such ribs may be utilized if necessary for longer lengths in which the smaller axial ribs become too long to effectively transfer stresses from the upper and lower portions in the bridge ribs.

Figure 13:
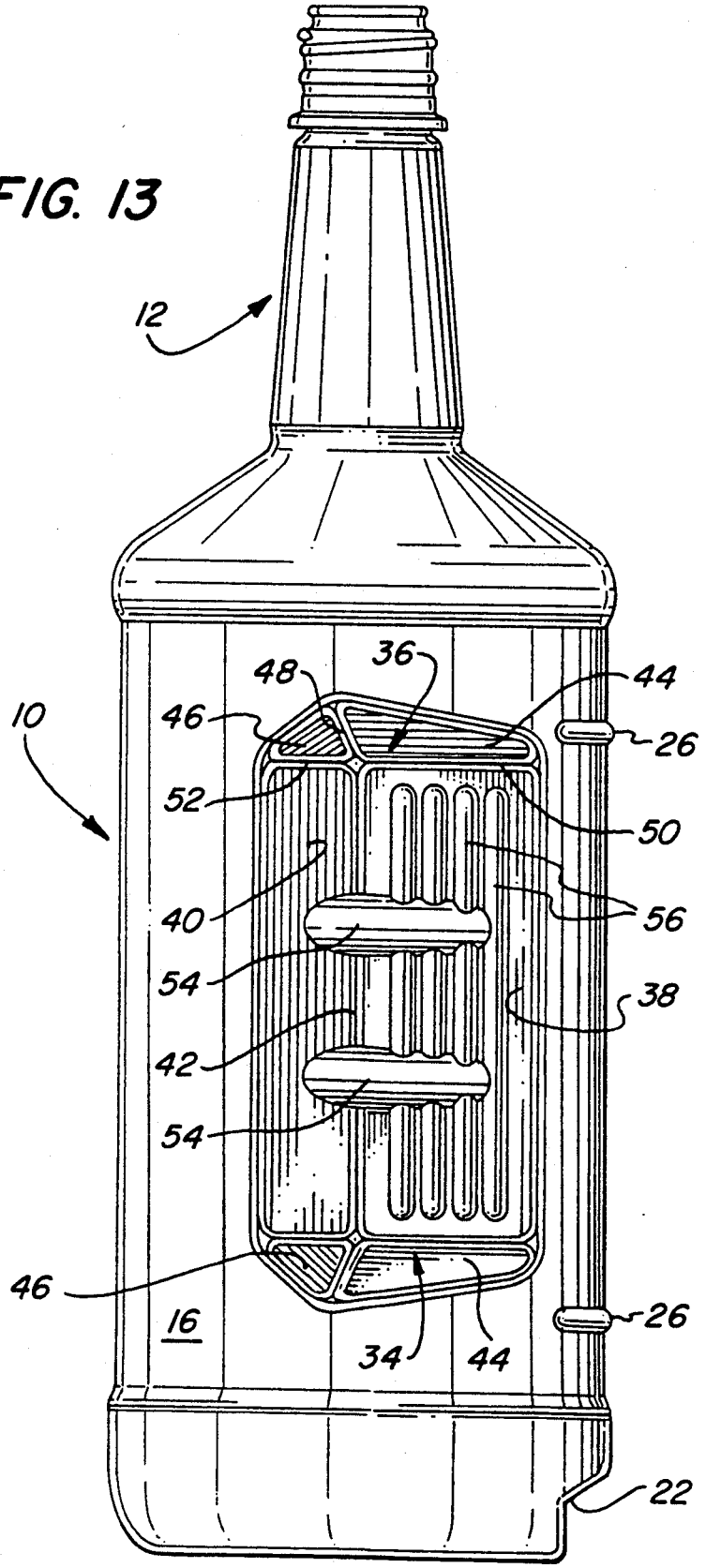
FIG. 13 is a perspective view of a bottle employing a grip with a pair of bridge ribs.

FIG. 13 illustrates a bottle with a pair of bridge ribs 54 spaced along the axial length of the grip recess 18, and the axial ribs 56 extend therebetween and also from the opposite surfaces thereof towards the upper and lower ends of the grip recess 18.

Illustrative of the efficacy of the container of the present invention is the following. A liquor bottle configuration substantially as illustrated in the attached drawings is formed having a total height of 12.08 inches and a maximum diameter of 4.500 inch. The axial length of the line of convergence 48-42-48 of the grip recess was 4.12 inches and the length of the chord between the outer side edges of the recess was 2.4 inch with the included angle between the walls 38, 40 being 133°. The average thickness of the peripheral wall of the body portion was 0.017 inch and the bridge rib had a maximum height at the line of convergence of 0.31 inch and a width of 0.54 inch.

The bottle was filled with water to the fill point, and capped tightly. The bottle was then dropped vertically into cardboard shipping cases with a double wall bottom a distance of two feet to simulate the drop case packers of most liquor bottle filling plants. The hydrostatic forces generated during the impact were successfully absorbed and distributed by the bottle in the grip area with no evidence of eversion of the grip. This test was repeatedly performed on several bottles indicating a high degree of resistance to eversion by the novel construction of the present invention.

Thus, it can be seen from the foregoing detailed description and attached drawings that the container of the present invention is one which provides highly effective grip recesses for ease of handling the container. These grip recesses effectively resist eversion due to impact forces acting upon the contents within the container or other internal forces resulting from the contents of the container. The containers can be readily fabricated in accordance with conventional stretch blow molding processes utilized with resins such as polyethylene terephthalate as well as with other thermoplastic resins. Although a single bridge rib will be effective for most applications, additional bridge ribs may be provided readily and cooperate effectively with axial ribs to provide resistance to eversion for very large grip recesses in larger containers.

Having thus described the invention, what is claimed is:

1. A blow bolded synthetic resin container having:

(a) a body portion with a bottom wall and a sidewall of generally circular cross section, and (b) a closure portion at the upper end of said sidewall and providing an opening to the container body portion and adapted to receive a closure, said sidewall of said body portion having a pair of vertically elongated grip recesses therein spaced about its periphery, each of said grip recesses being defined by top and bottom walls and first and second walls extending therebetween and converging along an axial lone at the maximum depth of said recess, said first wall extending inwardly of the periphery of said body portion at a relatively shallow angle to an imaginary chord drawn between the side edges of said recess, and said second wall extending inwardly at a steeper angle, said grip recess having a convex bridge rib extending horizontally and rectilinearly between said first and second walls and terminating at points spaced inwardly of said periphery of said sidewall to space its rectilinear outer surface inwardly of said periphery a distance of about ¼–¾ the maximum depth of said recess, said bridge rib having a width of about ¼–¾ inch, said first wall also having a plurality of axially extending ribs of smaller height and width than said bridge rib and extending axially from the upper and lower side surfaces of said bridge rib.

2. The blow molded container in accordance with claim 1 wherein said bridge rib is of generally inverted U-shaped cross section.

3. The blow molded container in accordance with claim 1 wherein said horizontally extending bridge rib substantially bisects the axial length of said grip recess.

4. The blow molded container in accordance with claim 1 wherein said top and bottom walls defining said recess are inclined inwardly to a smaller axial spacing therebetween at their inner ends at their lines of convergence with said first and second walls.

5. The blow molded container in accordance with claim 4 wherein each of said top and bottom walls of said grip recess has first and second portions extending along first and second walls respectively, and converging along a line which is inclined inwardly relative to a plane extending transversely of said body portion, to a reduced axial distance between the inner ends of said lines, the edges of said first and second portions spaced from said first and second walls defining the upper and lower margins of said grip recess and extending along the periphery of said body portion at an angle to the axis of said body portion to provide an increased axial distance between said top and bottom walls at the line of the convergence of said first and second portions.

6. The blow molded container in accordance with claim 1 wherein said grip recesses have an axial length of 2–5 inches.

7. The blow molded container in accordance with claim 1 wherein a plurality of axially spaced bridge ribs are provided in each of said grip recesses.

8. The blow molded container in accordance with claim 1 wherein said lines of convergence of said first and second walls of said pair of grip recesses are substantially diametrically spaced about the periphery of said container.

9. The blow molded container in accordance with claim 1 wherein said first wall extends at relatively shallow angle of 10°–35 ° to the imaginary chord extending between the side edges of said recess and said second wall extends a steeper angle of 25°–75° to said chord.

10. The blow molded container in accordance with claim 1 wherein the change in direction at the line of convergence between said walls defining said recess is relatively sharp.

11. The blow molded container in accordance with claim 1 wherein said axially extending ribs have a height of about 0.06–0.12 inch.

12. The blow molded container in accordance with claim 11 wherein said axially extending ribs have a width of about 0.08–0.25 inch.

* * * * *